US009544983B2

(12) United States Patent
Rajyaguru et al.

(10) Patent No.: US 9,544,983 B2
(45) Date of Patent: Jan. 10, 2017

(54) APPARATUS FOR AND METHOD OF SUPPLYING TARGET MATERIAL

(71) Applicant: ASML Netherlands B.V., Veldhoven (NL)

(72) Inventors: Chirag Rajyaguru, San Diego, CA (US); John M. Algots, San Diego, CA (US); Tetsuya Ishikawa, San Diego, CA (US); Peter Baumgart, San Diego, CA (US)

(73) Assignee: ASML NETHERLANDS B.V., Veldhoven (NL)

( * ) Notice: Subject to any disclaimer, the term of this patent is extended or adjusted under 35 U.S.C. 154(b) by 27 days.

(21) Appl. No.: 14/533,813

(22) Filed: Nov. 5, 2014

(65) Prior Publication Data

US 2016/0128170 A1 May 5, 2016

(51) Int. Cl.
*H05G 2/00* (2006.01)

(52) U.S. Cl.
CPC ..... *H05G 2/006* (2013.01); *H05G 2/008* (2013.01)

(58) Field of Classification Search
USPC ..... 250/504 R, 428, 526; 378/119, 125, 210
See application file for complete search history.

(56) References Cited

U.S. PATENT DOCUMENTS 6,760,406 B2 * 7/2004 Hertz ..... G03F 7/70033 250/504 R
7,405,416 B2 * 7/2008 Algots ..... H05G 2/003 222/591
7,439,530 B2 10/2008 Ershov et al.
7,449,703 B2 * 11/2008 Bykanov ..... B82Y 10/00 250/504 R
7,465,946 B2 12/2008 Bowering et al.
7,491,954 B2 2/2009 Bykanov et al.
7,605,385 B2 * 10/2009 Bauer ..... H05G 2/001 250/492.2
7,838,854 B2 * 11/2010 Algots ..... H05G 2/003 250/504 R
8,742,380 B2 * 6/2014 Hori ..... H05G 2/005 250/365
8,837,679 B2 * 9/2014 Hemberg ..... G03F 7/70033 378/125
9,279,445 B2 * 3/2016 Baumgart ..... F16C 11/12
2006/0192155 A1 * 8/2006 Algots ..... H05G 2/003 250/504 R
2012/0236273 A1 * 9/2012 Kameda ..... G03F 7/70025 355/30
2013/0153792 A1 * 6/2013 Baumgart ..... F16C 11/12 250/504 R
2014/0061512 A1 3/2014 Umeda
2014/0070021 A1 3/2014 Yabu et al.
2014/0261761 A1 * 9/2014 Vaschenko ..... H05G 2/005 137/334
2014/0348302 A1 * 11/2014 Hemberg ..... G03F 7/70033 378/125

OTHER PUBLICATIONS

International Search Report and Written Opinion of PCT Application No. PCT/US2015/056515 dated Jan. 6, 2016.

* cited by examiner

*Primary Examiner* — Bernard E Souw
(74) *Attorney, Agent, or Firm* — Arent Fox LLP

(57) ABSTRACT

An EUV light source target material handling system is disclosed which includes a target material dispenser and a target material repository in which solid target material in the target material repository is converted to target material in liquid form through the use of inductive heating.

20 Claims, 5 Drawing Sheets

APPARATUS FOR AND METHOD OF SUPPLYING TARGET MATERIAL

FIELD

The present disclosure relates supplying target material in a system that vaporizes the target material to produce radiation in the extreme ultraviolet ("EUV") portion of the electromagnetic spectrum.

BACKGROUND

Extreme ultraviolet light, e.g., electromagnetic radiation having a wavelength of around 50 nm or less (also sometimes referred to as soft x-rays), and including light at a wavelength of about 13.5 nm, can be used in photolithography processes to produce extremely small features in substrates such as silicon wafers. Here and elsewhere herein the term "light" will be used even though it is to be understood that the radiation described using that term may not be in the visible part of the spectrum.

Methods for generating EUV light include converting a target material from a liquid state into a plasma state. The target material preferably includes at least one element, e.g., xenon, lithium or tin, with one or more emission lines in the EUV part of the spectrum. In one such method, often termed laser produced plasma ("LPP"), the required plasma is produced by using a laser beam to irradiate and so to vaporize a target material having the required line-emitting element to form a plasma in an irradiation region.

The target material may take many forms. It may be solid or a molten. If molten, it may be dispensed in several different ways such as in a continuous stream or as a stream of discrete droplets. As an example, the target material in much of the discussion which follows is molten tin which is dispensed as a stream of discrete droplets. It will be understood by one of ordinary skill in the art, however, that other target materials, phases of target materials, and delivery modes for target materials may be used.

The energetic radiation generated during de-excitation and recombination of ions in the plasma propagates from the plasma omnidirectionally. In one common arrangement, a near-normal-incidence mirror (often termed a "collector mirror" or simply a "collector") is positioned to collect, direct (and in some arrangements, focus) the light to an intermediate location. The collected light may then be relayed from the intermediate location to where it is to be used, for example, to a set of scanner optics and ultimately to a wafer in the case where the EUV radiation is to be used for semiconductor photolithography.

The target material is introduced into the irradiation region by a target material dispenser. The target material dispenser is supplied with target material in a liquid or solid form. If supplied with target material in a solid form the target material dispenser melts the target material. The target material dispenser then dispenses the molten target material into the vacuum chamber containing the irradiation region as a series of droplets.

As can be appreciated, one technical requirement for implementation of a target material dispenser is the supply of target material to the target material dispenser. Ideally target material is supplied in a manner that does not require frequent or protracted interruptions in the operation of the overall system for producing EUV radiation, that is, the EUV source. At the same time, because it is desirable to provide for the ability to "steer" the target material dispenser precisely and repeatably (i.e., alter the position of the point at which the target material dispenser releases target material into the vacuum chamber), it is also desirable to provide a target material dispenser that has relatively low mass. There is thus a need to supply the target material dispenser with target material in a manner which does not require undue interruption in the operation of the overall EUV source and which does not add undue mass to the target material dispenser.

SUMMARY

The following presents a simplified summary of one or more embodiments in order to provide a basic understanding of the embodiments. This summary is not an extensive overview of all contemplated embodiments, and is not intended to identify key or critical elements of all embodiments nor delineate the scope of any or all embodiments. Its sole purpose is to present some concepts of one or more embodiments in a simplified form as a prelude to the more detailed description that is presented later.

According to one aspect, there is provided an apparatus for supplying target material to a system for generating EUV radiation by creating a plasma from molten target material at a plasma site, the apparatus comprising a target material repository adapted to receive target material in solid form, the target material repository comprising a chamber for receiving target material in solid form, and an induction heater in electromagnetic communication with the chamber and arranged to heat target material in the chamber by electromagnetic induction and convert target material in solid form in the chamber to target material in liquid form. The apparatus also includes a target material dispenser in fluid communication with the target material repository and arranged to receive target material in liquid form from the target material repository and to dispense the target material in liquid form to the plasma site.

The chamber may be an interior of an electrically insulating housing and the induction heater may comprise a coil wound around at least part of the electrically insulating housing. The electrically insulating housing may comprise a ceramic material. The coil may comprise litz wire. The electrically insulating housing may also comprise an insertion port for inserting target material in solid form into the chamber. The electrically insulating housing may also comprise an inlet port for supplying a buffer gas to the chamber. The electrically insulating housing may also comprise a port for applying a partial vacuum to the chamber.

According to another aspect, there is provided apparatus for supplying target material to a system for generating EUV radiation by creating a plasma from molten target material at a plasma site, the apparatus comprising a target material repository adapted to receive target material in solid form, the target material repository comprising a ceramic housing comprising a chamber adapted to receive target material in solid form through an insertion port in the ceramic housing, and a coil in electromagnetic communication with the chamber and arranged to heat target material in the chamber by electromagnetic induction and convert target material in solid form in the chamber to target material in liquid form; and an outlet port in the ceramic housing for permitting melted target material to flow from the chamber, with the ceramic housing also including an inlet port to permit introduction of a buffer gas into the chamber.

According to another aspect there is provided an apparatus for supplying target material to a system for generating EUV radiation by creating a plasma from molten target material at a plasma site, the apparatus comprising a target material loader including a target material repository adapted to receive target material in solid form, the target material repository comprising a chamber for receiving target material in solid form, and an induction heater in electromagnetic communication with the chamber and arranged to heat target material in the chamber by electromagnetic induction and convert target material in solid form in the chamber to target material in liquid form, the target material loader being adapted to be handheld, a target material dispenser arranged to dispense the target material in liquid form to the plasma site, and a coupler for releasably coupling the target material loader to the target material dispenser for loading the target material with target material in liquid form.

According to another aspect of the invention, there is provided an apparatus for supplying target material to a system for generating EUV radiation by creating a plasma from molten target material at a plasma site, in which the apparatus includes a target material loader including a target material repository adapted to receive a wire, the wire comprising target material in solid form, the target material repository comprising a chamber for receiving the wire, and an induction heater in electromagnetic communication with an interior of the chamber and arranged to heat the wire in the chamber by electromagnetic induction and convert target material in the wire in the chamber to target material in liquid form. The chamber may comprise ceramic material or a glass material.

The apparatus may further include a target material dispenser arranged to dispense the target material in liquid form to the plasma site and a valve disposed between the chamber and the target material dispenser for controlling a flow of target material in liquid form between the chamber and the target material dispenser. The valve may be a ball valve. The apparatus may also further include a spool for holding a quantity of the wire and a wire transport system for feeding the wire from the spool to the chamber. The apparatus may further include a gas supply system for supplying gas to the interior of the chamber. The gas may be a forming gas.

According to another aspect there is provided a method of generating EUV radiation by creating a plasma from a molten target material at a plasma site, the method comprising adding target material in solid form to a target material repository, inductively heating the target material in solid form in the target material repository to heat the target material in the target material repository chamber by electromagnetic induction and convert the target material in solid form in the target material repository to target material in liquid form, supplying the target material in liquid form from the target material repository to a target material dispenser, and using the target material dispenser to dispense the target material in liquid form to the plasma site. The method may include the additional step of adding a buffer gas to the target material repository while adding target material in solid form to the target material repository.

DETAILED DESCRIPTION

Figure 1:
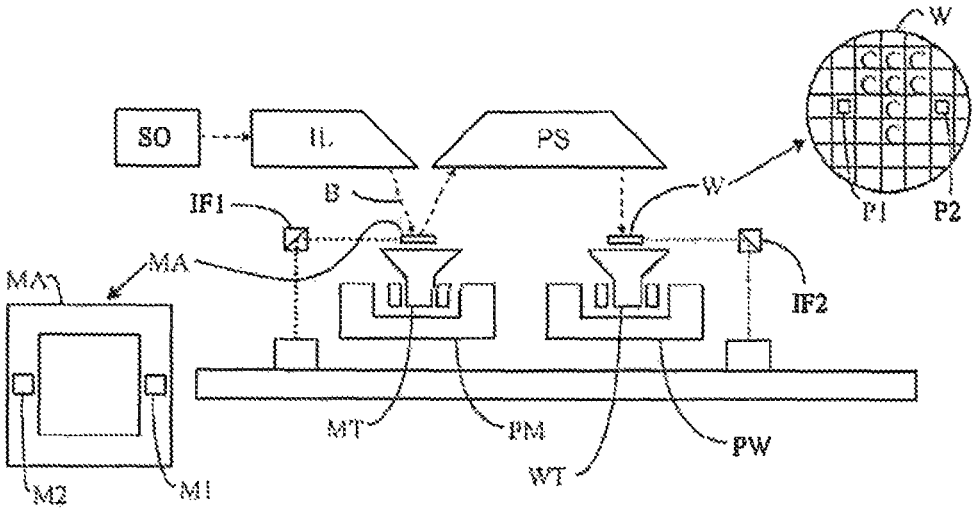
FIG. 1 shows a schematic, not to scale, view of an overall broad conception for a laser-produced plasma EUV light source system according to an aspect of the present invention.

Various embodiments are now described with reference to the drawings, wherein like reference numerals are used to refer to like elements throughout. In the following description, for purposes of explanation, numerous specific details are set forth in order to promote a thorough understanding of one or more embodiments. It may be evident in some or all instances, however, that any embodiment described below can be practiced without adopting the specific design details described below. In other instances, well-known structures and devices are shown in block diagram form in order to facilitate description of one or more embodiments. The following presents a simplified summary of one or more embodiments in order to provide a basic understanding of the embodiments. This summary is not an extensive overview of all contemplated embodiments, and is not intended to identify key or critical elements of all embodiments nor delineate the scope of any or all embodiments.

FIG. 1 schematically depicts a lithographic apparatus according to an embodiment of the invention. The apparatus comprises an illumination system IL configured to condition a radiation beam B of radiation. The apparatus also includes a support structure (e.g. a mask table) MT constructed to support a patterning device (e.g. a mask) MA and connected to a first positioner PM configured to accurately position the patterning device in accordance with certain parameters; a substrate table (e.g. a wafer table) WT constructed to hold a substrate (e.g. a resist-coated wafer) W and connected to a second positioner PW configured to accurately position the substrate in accordance with certain parameters; and a projection system (e.g. a refractive or reflective projection lens system) PS configured to project a pattern imparted to the radiation beam B by patterning device MA onto a target portion C (e.g. comprising one or more dies) of the substrate W.

The illumination system IL may include various types of optical components, such as refractive, reflective, magnetic, electromagnetic, electrostatic or other types of optical components, or any combination thereof, for directing, shaping, or controlling radiation.

The support structure MT holds the patterning device in a manner that depends on the orientation of the patterning device, the design of the lithographic apparatus, and other conditions, such as for example whether or not the patterning device is held in a vacuum environment. The support structure MT can use mechanical, vacuum, electrostatic or other clamping techniques to hold the patterning device. The support structure MT may be a frame or a table, for example, which may be fixed or movable as required. The support structure MT may ensure that the patterning device is at a desired position, for example with respect to the projection system.

Referring to FIG. 1, the illumination system IL receives a radiation beam from a radiation source SO. The source SO and the illumination system IL, together with the beam delivery system if required, may be referred to as a radiation system.

The illumination system IL may comprise an adjuster for adjusting the angular intensity distribution of the radiation beam. Generally, at least the outer and/or inner radial extent (commonly referred to as .sigma.-outer and .sigma.-inner, respectively) of the intensity distribution in a pupil plane of the illumination system can be adjusted. In addition, the illumination system IL may comprise various other components, such as an integrator and a condenser. The illumination system may be used to condition the radiation beam, to have a desired uniformity and intensity distribution in its cross-section.

The radiation beam B is incident on the patterning device (e.g., mask) MA, which is held on the support structure (e.g., mask table) MT, and is patterned by the patterning device. Having traversed the patterning device MA, the radiation beam B passes through the projection system PS, which focuses the beam onto a target portion C of the substrate W. With the aid of the second positioner PW and position sensor IF2 (e.g. an interferometric device, linear encoder or capacitive sensor), the substrate table WT can be moved accurately, e.g. so as to position different target portions C in the path of the radiation beam B. Similarly, the first positioner PM and another position sensor IF1 can be used to accurately position the patterning device MA with respect to the path of the radiation beam B, e.g. after mechanical retrieval from a mask library, or during a scan.

Figure 2:
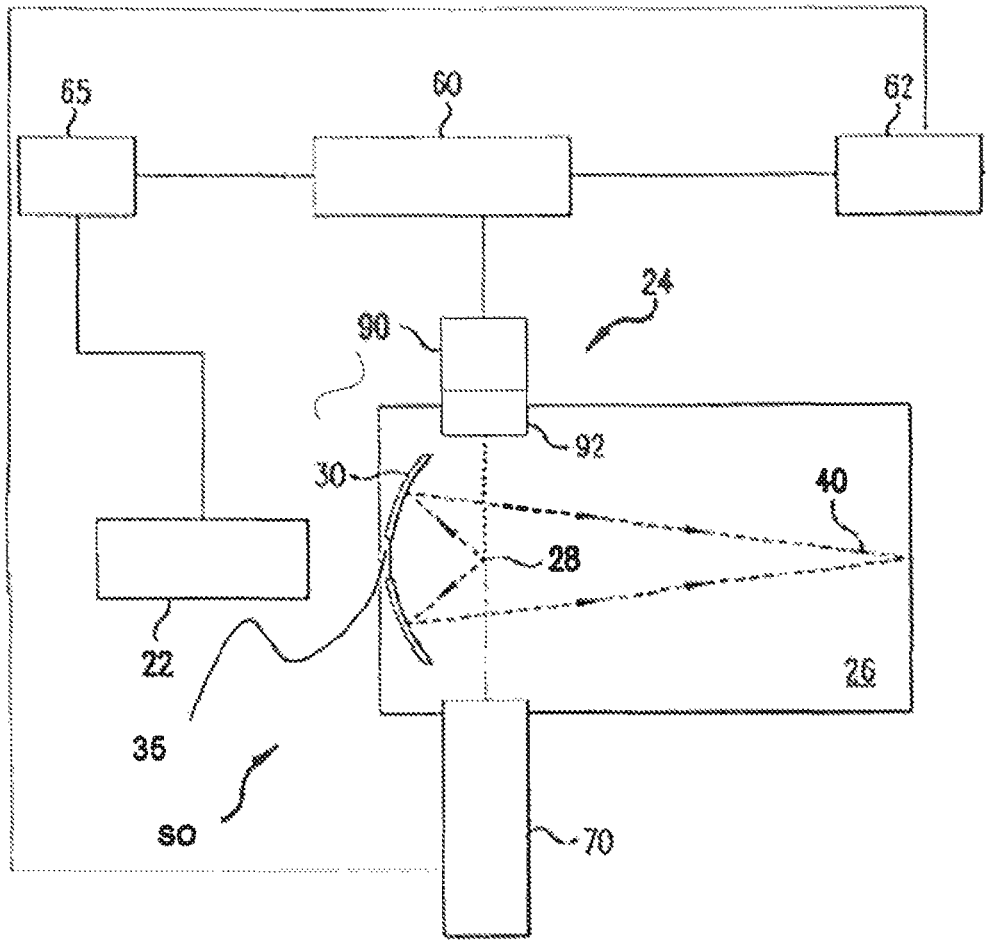
FIG. 2 is a functional block diagram of a light source for the system of FIG. 1.

FIG. 2 shows an embodiment of a source SO such as could be used in the apparatus of FIG. 1 in more detail. The source SO generates EUV radiation from a plasma which is formed at a plasma formation site or irradiation region 28. The plasma is created by directing a laser beam onto a suitable target material such as Sn or Gd which is introduced into the chamber 26 by target material dispenser 24. The laser beam causes the target material to be vaporized, thereby generating the plasma. As mentioned, a source of this type may be referred to as a laser produced plasma or LPP source. The LPP light source SO may include a system 22 for generating a train of light pulses and delivering the light pulses into a chamber 26. As detailed below, each light pulse may travel along a beam path from the system 22 and into the chamber 26 to illuminate a respective target droplet at a plasma site or an irradiation region 28. It should be noted that as used herein an irradiation region is a region for source material irradiation to occur, and is an irradiation region even at times when no irradiation is actually occurring. Similarly, a plasma site is a region where plasma is to be generated and is a plasma site even at times when no plasma is actually being generated. In the example which follows, the example of a target material dispenser 24 that dispenses target material in the form of droplets of target material will be used. It will be appreciated, however, that the target material dispenser 24 can also dispense target material in other forms, including a continuous stream of target material.

Suitable lasers for use in the system SO shown in FIG. 2 may include a pulsed laser device, e.g., a pulsed gas discharge $CO_2$ laser device producing radiation at 9.3 μm or 10.6 μm, e.g., with DC or RF excitation, operating at relatively high power, e.g., 10 kW or higher and high pulse repetition rate, e.g., 50 kHz or more. In one particular implementation, the laser may be an axial-flow RF-pumped $CO_2$ laser having an oscillator-amplifier configuration (e.g. master oscillator/power amplifier (MOPA) or power oscillator/power amplifier (POPA)) with multiple stages of amplification and having a seed pulse that is initiated by a Q-switched oscillator with relatively low energy and high repetition rate, e.g., capable of 100 kHz operation. From the oscillator, the laser pulse may then be amplified, shaped and/or focused before reaching the irradiation region 28. Continuously pumped $CO_2$ amplifiers may be used for the system SO. For example, a suitable $CO_2$ laser device having an oscillator and three amplifiers (O-PA1-PA2-PA3 configuration) is disclosed in U.S. Pat. No. 7,439,530, issued on Oct. 21, 2008, the entire contents of which are hereby incorporated by reference herein. Alternatively, the laser may be configured as a so-called "self-targeting" laser system in which the droplet serves as one mirror of the optical cavity. In some "self-targeting" arrangements, an oscillator may not be required. Self-targeting laser systems are disclosed and claimed in U.S. Pat. No. 7,491,954, issued on Feb. 17, 2009, the entire contents of which are hereby incorporated by reference herein.

Depending on the application, other types of lasers may also be suitable, e.g., an excimer or molecular fluorine laser operating at high power and high pulse repetition rate. Other examples include, a solid state laser, e.g., having a fiber, rod, slab or disk-shaped active media, other laser architectures having one or more chambers, e.g., an oscillator chamber and one or more amplifying chambers (with the amplifying chambers in parallel or in series), a master oscillator/power oscillator (MOPO) arrangement, a master oscillator/power ring amplifier (MOPRA) arrangement, or a solid state laser that seeds one or more excimer, molecular fluorine or $CO_2$ amplifier or oscillator chambers, may be suitable. Other designs may be suitable.

As further shown in FIG. 2, the target material dispenser 24 delivers target material into the interior of the chamber 26 to the irradiation region or plasma site 28, where the target material will interact with one or more light pulses, e.g., zero, one or more pre-pulses and thereafter one or more main pulses, to ultimately produce a plasma and generate an EUV emission. The EUV emitting element, e.g., tin, lithium, xenon, etc., may be in the form of liquid droplets and/or solid particles contained within liquid droplets. For example, the element tin may be used as pure tin, as a tin compound, e.g., $SnBr_4$, $SnBr_2$, $SnH_4$, as a tin alloy, e.g., tin-gallium alloys, tin-indium alloys, tin-indium-gallium alloys, or a combination thereof. Depending on the material used, the target material may be presented to the irradiation region 28 at various temperatures including room temperature or near room temperature (e.g., tin alloys, $SnBr_4$), at an elevated temperature, (e.g., pure tin) or at temperatures below room temperature, (e.g., $SnH_4$), and in some cases, can be relatively volatile, e.g., $SnBr_4$. More details concerning the use of these materials in an LPP EUV light source is provided in U.S. Pat. No. 7,465,946, issued on Dec. 16, 2008, the entire contents of which are hereby incorporated by reference herein. In some cases, an electrical charge is placed on the target material to permit the target material to be steered toward or away from the irradiation region 28.

Continuing with FIG. 2, the light source SO may also include one or more EUV optical elements such as EUV optic 30. The EUV optic 30 may be a collector mirror in the form of a normal incidence reflector, for example, implemented as a multilayer mirror (MLM), that is, a SiC substrate coated with a Mo/Si multilayer with additional thin barrier layers deposited at each interface to effectively block thermally-induced interlayer diffusion. Other substrate materials, such as Al or Si, can also be used. The EUV optic 30 may be in the form of a prolate ellipsoid, with an aperture 35 to allow the laser light to pass through and reach the irradiation region 28. The EUV optic 30 may be, e.g., in the shape of a ellipsoid that has a first focus at the irradiation region 28 and a second focus at a so-called intermediate point 40 (also called the intermediate focus 40) where the EUV light may be output from the EUV light source 20 and input to, e.g., an integrated circuit lithography tool as described above.

The EUV light source 20 may also include an EUV light source controller system 60, which may also include a laser firing control system 65, along with, e.g., a laser beam positioning system (not shown). The EUV light source 20 may also include a target position detection system which may include one or more droplet imagers 70 that generate an output indicative of the absolute or relative position of a target droplet, e.g., relative to the irradiation region 28, and provide this output to a target position detection feedback system 62. The target position detection feedback system 62 may use this output to compute a target position and trajectory, from which a target error can be computed. The target error can be computed on a droplet-by-droplet basis, or on average, or on some other basis. The target error may then be provided as an input to the light source controller 60. In response, the light source controller 60 can generate a control signal such as a laser position, direction, or timing correction signal and provide this control signal to a laser beam positioning controller (not shown). The laser beam positioning system can use the control signal to control the laser timing circuit and/or to control a laser beam position and shaping system (not shown), e.g., to change the location and/or focal power of the laser beam focal spot within the chamber 26.

As shown in FIG. 2, the light source SO may include a target delivery control system 90. The target delivery control system 90 is operable in response to a signal, for example, the target error described above, or some quantity derived from the target error provided by the system controller 60, to correct for errors in positions of the target droplets within the irradiation region 28. This may be accomplished, for example, by repositioning the point at which a target material delivery mechanism 24 releases the target droplets. The target material delivery mechanism 24 extends into the chamber 26 and is also externally supplied with target material and a gas source to place the target material in the target material delivery mechanism 24 under pressure.

Figure 3:
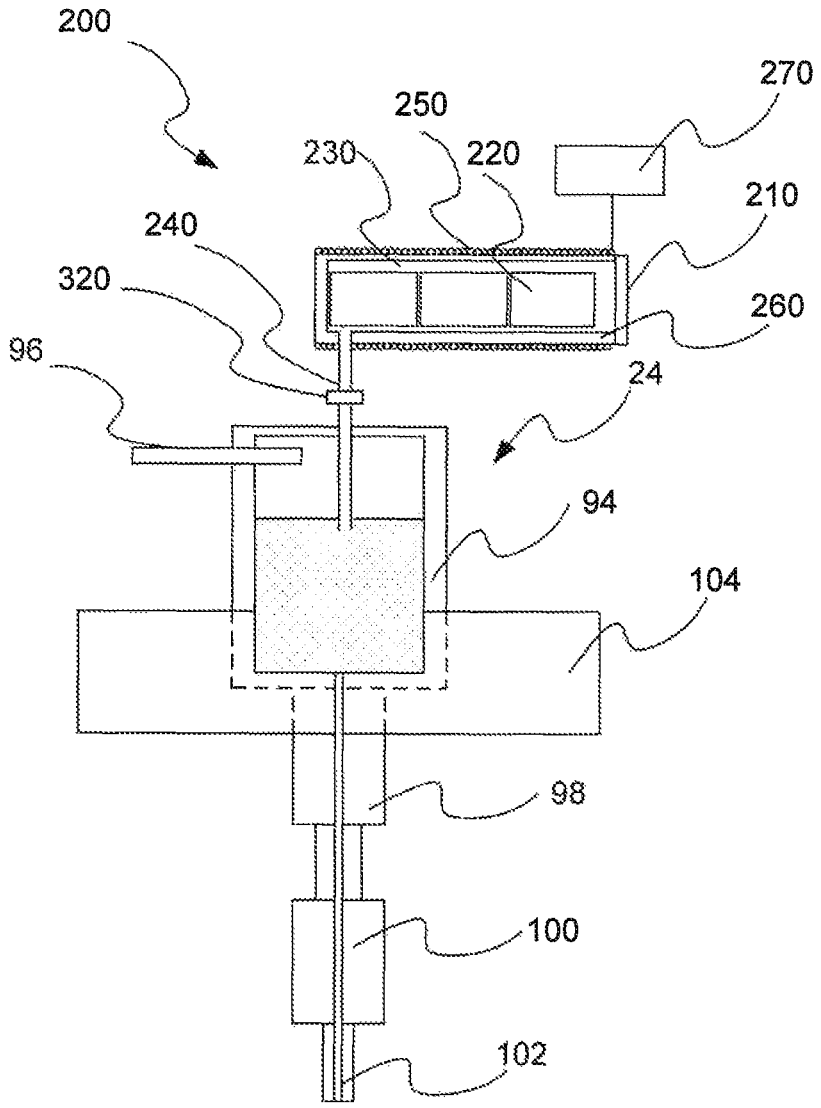
FIG. 3 is a functional block diagram of a target material supply and dispensing system for the light source of FIG. 2.

FIG. 3 shows in greater detail a target material delivery mechanism 24 for delivering target material into the chamber 26. For the generalized embodiment shown in FIG. 3, the target material delivery mechanism 24 may include a reservoir 94 holding a molten target material such as tin. Heating elements (not shown) controllably maintain the target material delivery mechanism 24 or selected sections thereof at a temperature above the melting temperature of the target material. The molten target material may be placed under pressure by using an inert gas such as argon introduced through a feed line 96. The pressure preferably forces the target material to pass through a set of filters 98. From the filters 98, the material may pass through a valve 100 to a nozzle 102. For example valve 100 may be a thermal valve. A Peltier device may be employed to establish the valve 100, freezing target material between the filters 98 and nozzle 102 to close the valve 100 and heating the solidified target material to open the valve 100. FIG. 3 also shows that the target delivery system 92 is coupled to a movable member 104 such that motion of the movable member 104 changes the position of the point at which droplets are released from the nozzle 102. Motion of the movable member 104 is controlled by a droplet release point positioning system, as described in co-pending U.S. patent application Ser. No. 13/328,628, titled "DROPLET GENERATOR STEERING SYSTEM" filed on Dec. 16, 2011 and published Jun. 20, 2013 as Pub. No. 2013/0153792, assigned to Cymer Inc., the entirety of which is hereby incorporated by reference herein.

For the target material delivery mechanism 24, one or more modulating or non-modulating target material dispensers may be used. For example, a modulating dispenser may be used having a capillary tube formed with an orifice. The nozzle 102 may include one or more electro-actuatable elements, e.g. actuators made of a piezoelectric material, which can be selectively expanded or contracted to deform the capillary tube and modulate a release of source material from the nozzle 102. Examples of modulating droplet dispensers can be found in U.S. Pat. No. 7,838,854.

It is preferred to supply the reservoir 94 with target material in a liquid form. Thus, for target material which is initially supplied in solid form, it is preferred to have a target material supply system that receives the solid target material, converts the target material to liquid form by melting the target material, and supplying the melted target material to the target material delivery mechanism 24. Such a target material loading system is shown in FIG. 3 as element 200. As shown, the target material loading system 200 has a door or port 210 through which solid target material 220 can be placed in a chamber 230 in the target material supply system 200. In the example shown the target material 220 is in the form of solid bars of target material but other forms for the target material may be used. The chamber 230 is in fluid communication with the reservoir 94 through a supply line 240. Here and in the claims, when two elements are said to be in fluid communication is intended to connote the fluid such as a liquid or gas can flow between the two of them either directly or indirectly, that is, through intervening elements. Solid target material 220 in the chamber 230 is melted, and the melted target material is conveyed to the reservoir 94.

According to one aspect the preferred embodiments, the melting of target material is accomplished using an inductive heater. Conventional methods of melting target material use electrical heaters to heat a vessel holding the target material and rely on transfer of heat from the vessel to the target material within the vessel to melt the target material. This method of heating the target material suffers from at least two disadvantages. The first disadvantage is that it can take a substantial amount of heating time to heat the vessel to the melting temperature of the target material and a substantial amount of cooling time to for the vessel to cool down to a temperature at which additional solid target material can be added to the repository. Protracted heating and cooling times can increase the overall reload time, that is, the amount of time required to cool the vessel, open it, reload it, close it, and heat the vessel back past the melting temperature of the target material. The other disadvantage of heating the vessel to indirectly heat the target material inside the vessel is that energy that is not ultimately used to heat the target material but is instead use only to heat the vessel is wasted.

To minimize or avoid these disadvantages, according to an aspect of the present invention the energy needed to melt the target material is coupled directly into the target material. This is accomplished by using induction heating to induce eddy currents in the target material. This avoids the use of any intermediate medium to transfer heat from a heat source to the target material. This has the potential to minimize the amount of time it is necessary to stop droplet production during a reload operation.

According to one embodiment of the invention that target material heater includes an inductive heater in the form of a coil 250 arranged to couple energy into the chamber 230. The coil 250 is preferably made of litz wire to carry alternating current. Litz wire is preferred because it is designed to reduce the skin effect and proximity effect losses in conductors used at frequencies up to about 1 MHz. It typically is made up of many thin wire strands, individually insulated and twisted or woven together. In the embodiment of FIG. 3 the coil is wrapped around an insulating housing 260 which defines the chamber 230 and electrically insulates the coil 250 from the rest of the system. In a presently preferred embodiment the insulating housing 260 is made of a ceramic material but other materials such as a glass material may be used. The coil 250 is supplied with power by an alternating current power supply 270. The coil 250 is in electromagnetic communication with the interior of the chamber 230, that is, that electromagnetic field produced by current flowing through the coil 250 is capable of reaching the interior of the chamber 230.

The housing 260 is adapted to receive target material in solid form. As used herein, "adapted to receive" means the housing 260 and the chamber 230 are dimensioned to accommodate target material in solid form of a given shape, and are provided with suitable apertures, ports, or other means of ingress to permit introduction the target material on solid form into the interior of the housing 260 and the chamber 230. In use, the port 210 is opened and solid target material 220 is added to the chamber 230. The port 210 is then closed and alternating current is supplied to the coil 250 by the alternating current power supply 270. The flow of current in the coil 250 induces eddy currents in the solid target material 220 thus causing the target material to heat and melt. The melted target material then flows to the reservoir 94 through the supply line 240.

It is preferable in some instances to supply a gas to the chamber 230 to protect the melted target material from the atmosphere, for example, from oxidation. Towards this end is presently preferred to use a buffer gas, that is, an inert or nonflammable gas to reduce the amount of oxygen in the chamber. It is also possible, however, to use other gases such as forming gases to reduce oxidation. It is also preferable in some instances to maintain the chamber 230 under a vacuum to protect the melted target material from undergoing undesired chemical reactions with atmospheric gases. These ends are accomplished by supplying the target material supply system with gas and vacuum connections, not shown in FIG. 3.

The volume of the chamber 230 can be selected to be a fraction of the volume of the reservoir in the target material dispenser. As an example, for a target material reservoir having a volume of about 400 ml, the volume of the chamber could be about 200 ml, or fifty percent of the reservoir capacity.

Figure 4:
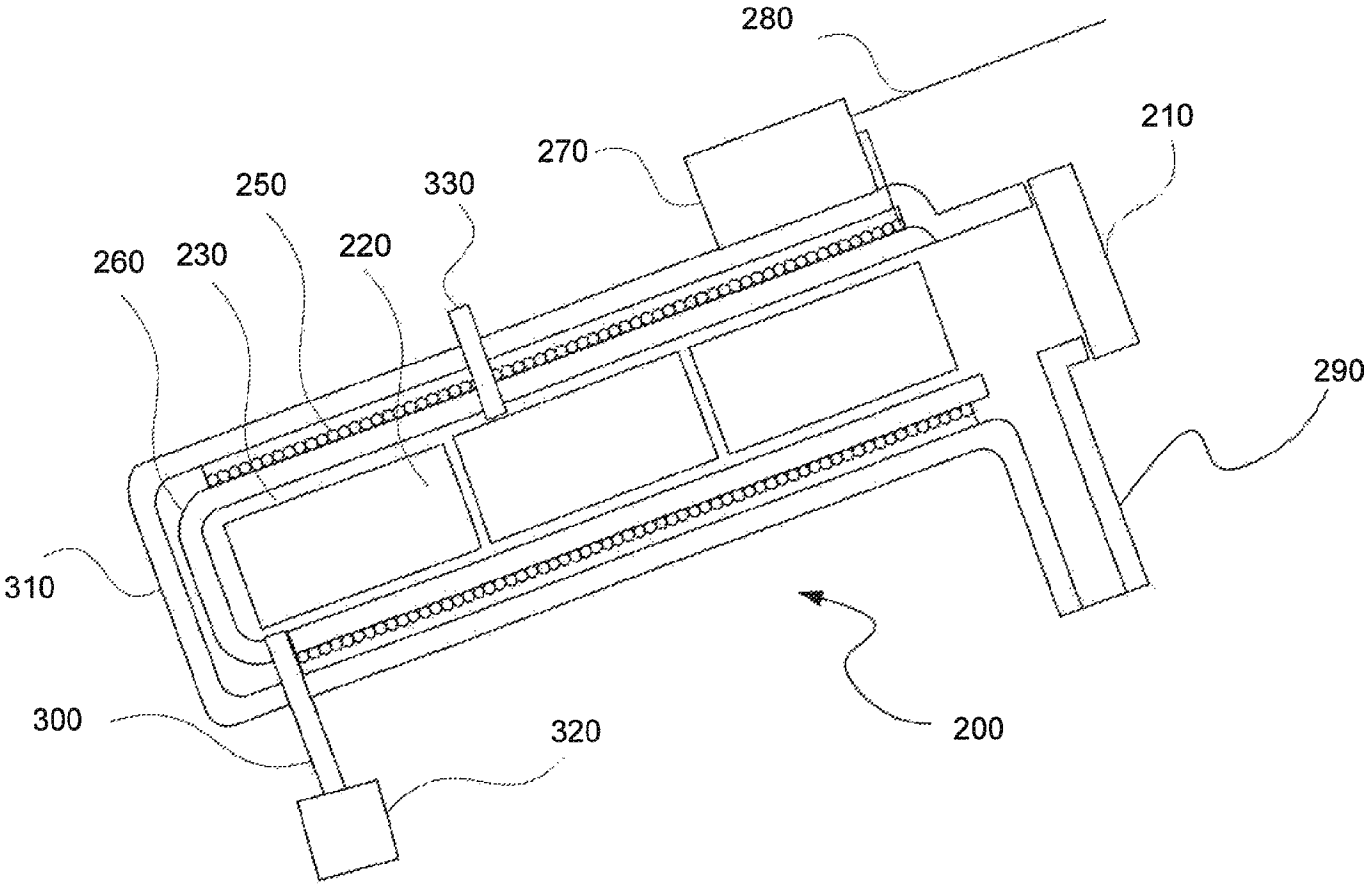
FIG. 4 is a conceptual cutaway view of an embodiment of a target material supply system such as could be used in the system of FIG. 3.

FIG. 4 shows an embodiment of a target material loading system that is intended to be handheld. In the embodiment of FIG. 4 the target material supply system 200 again includes an inductive heater in the form of a coil 250 arranged to couple energy into the chamber 230. The coil 250 is again preferably made of litz wire to carry alternating current. In the embodiment of FIG. 4 the coil 250 is wrapped around an insulating housing 260 which defines the chamber 230 and electrically insulates the coil 250 from the rest of the system. In a presently preferred embodiment the insulating housing 260 is made of a ceramic material but other materials such as a glass material may be used. The coil 250 is supplied with power by an alternating current power supply 270 which receives power from a line 280.

In use, the port 210 is opened and solid target material 220 in the form of bars of tin is inserted into the chamber 230. The port 210 is then closed and alternating current is supplied to the coil 250 by the alternating current power supply 270. The flow of current in the coil 250 induces eddy currents in the solid target material 220 thus causing the target material to heat and melt. The melted target material then flows to the reservoir 94 through the supply line 240.

As noted it is preferable in some instances to supply a buffer gas such as argon, helium, or some combination of the two to the chamber 230 to protect the melted target material from the atmosphere, for example, from oxidation. This is accomplished in the embodiment of FIG. 4 through an inlet 290. It is also preferable in some instances to maintain the chamber 230 under a vacuum to protect the melted target material from undergoing undesired chemical reactions with atmospheric gases. This is also accomplished in the embodiment of FIG. 4 through the inlet 290. As noted above, a forming gas can also use for this purpose.

The embodiment of FIG. 4 also includes a port 330 for introducing buffer or forming gas when the insertion port 210 is opened. The embodiment of FIG. 4 also includes an outlet port 300 through which melted target material can flow into the supply line 240. To facilitate the convenience of using a handheld version of the target material supply system 200 the inlet port 290 and the outlet port 300 can be provided with a rapid connect/disconnect connector 320. The target material supply system 200 is contained within a housing 310. As shown, in use the target material supply system 200 can be operated at a downward angle with respect to horizontal, that is, so that the outlet port 300 is lower than the insertion port 210, so that the flow of melted target material to the outlet port can be assisted by gravity.

When the target material 220 is in the form of solid bars it is presently preferred that the bars be cylindrical form. The diameter of the bars is preferably in the range of about 20 mm to about 30 mm. The length of the bars is preferably in the range of about 100 mm to about 150 mm. The bars may, however, be of lengths shorter than 100 mm, with several of the bars being stacked in the chamber 230 to fill it.

The target material loading system 200 is preferably not permanently connected to the target material dispensing system 92. Instead, it is preferred that the target material loading system 200 be dimensioned and light enough that it can be manipulated without the use of additional handling equipment, i.e., that it can be operated "handheld." The target material loading system 200 is also preferably releasably coupled to the target material dispensing system 92 so that the target material loading system 200 can be in fluid communication to the target material dispensing system 92 when loading is required but can be disconnected from the target material dispensing system 92 when loading is not required.

The volume of the chamber 230 can be selected to be a fraction of the volume of the reservoir in the target material dispenser. As an example, for a target material reservoir having a volume of about 400 ml, the volume of the chamber could be about 200 ml, or fifty percent of the reservoir capacity.

Figure 5:
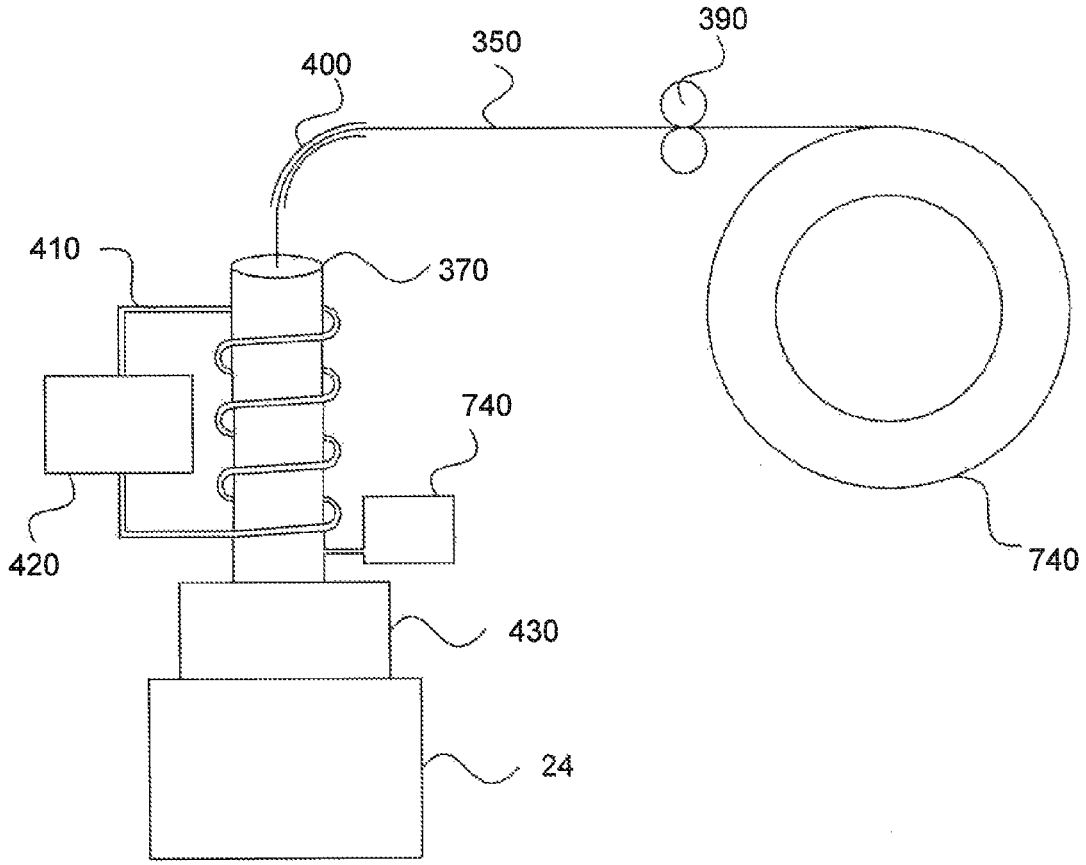
FIG. 5 is a diagram of another embodiment of a target material supply system.

Turning now FIG. 5, it shows an embodiment of and apparatus for supplying target material where the solid form the target material is a wire 350 having a composition that includes the target material. The wire 350 is fed from a spool 360 and conveyed to the chamber 370 by a wire transport system. The wire transport system may include, for example a pair of pinch rollers 390 and a wire guide 400.

In a presently preferred embodiment the wire 350 is comprised entirely of substantially pure target material (that is, without deliberate introduction of materials other than target material). It is presently preferred that the wire 350 have a diameter in range of about 1 mm to about 3 mm. As for the capacity of spool 360, it is presently preferred that the spool 360 be dimensioned to hold about 200 m of 2 mm wire, giving about 600 cc of target material. This should provide the EUV source with enough target material to operate continuously for a period of time in the range of about 100 hours to about 200 hours.

As mentioned, the wire 350 is conveyed to a wire inlet in the chamber 370. In a presently preferred embodiment, the chamber 370 is configured as a tube made of a glass or ceramic material. An induction coil 410 is wound around the tube and supplied with current from a current supply 420. As described above, the current supply 420 preferably supplies an alternating current and the induction coil 410 is preferably made of litz wire.

It is also a presently preferred to supply a gas to the interior of the chamber 370. In the embodiment shown, this gas is supplied by a gas supply 430. The gas supplied by the gas supply may be a buffer gas or it may be a forming gas (reducing gas) to reduce the amount of oxygen in the tube and so to reduce the formation of oxides. As is known, forming gas is usually a mixture of molecular hydrogen ($H_2$) and an inert gas (usually nitrogen, $N_2$) that is used to reduce oxides on metal surfaces.

The embodiment of FIG. 5 also includes a valve 440 to control the flow of molten target material from the chamber 370 to the target material dispenser 24. For example, the valve 440 may be used to selectably prevent and permit the flow of molten target material from the chamber 370 to the target material dispenser 24.

The above described embodiments are used in a method of generating EUV radiation as follows. Target material in solid form is added to a target material repository. The target material in solid form in the repository is heated by electromagnetic induction to convert the target material in solid form in the target material repository to target material in liquid form. The target material in liquid form is supplied from the target material repository to a target material dispenser. The target material dispenser dispenses the target material in liquid form to the plasma site. Gas may be introduced into to the target material repository while adding target material in solid form to the target material repository.

The above description includes examples of multiple embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is construed when employed as a transitional word in a claim. Furthermore, although elements of the described aspects and/or embodiments may be described or claimed in the singular, the plural is contemplated unless limitation to the singular is explicitly stated. Additionally, all or a portion of any aspect and/or embodiment may be utilized with all or a portion of any other aspect and/or embodiment, unless stated otherwise.

What is claimed is:

1. Apparatus for supplying target material to a system for generating EUV radiation by creating a plasma from molten target material at a plasma site, the apparatus comprising:

a target material repository comprising a chamber for receiving target material in solid form, and an induction heater in electromagnetic communication with an interior of the chamber and arranged to heat target material in the chamber by electromagnetic induction and convert target material in the chamber in solid form to target material in liquid form; and a target material dispenser releasably connected to the target material repository and arranged to receive target material in liquid form from the target material repository and to dispense the target material in liquid form to the plasma site.

2. Apparatus as claimed in claim 1 wherein the chamber is an interior of an electrically insulating housing and the induction heater comprises a coil wound around at least part of the electrically insulating housing.

3. Apparatus as claimed in claim 2 wherein the electrically insulating housing comprises a ceramic material.

4. Apparatus as claimed in claim 2 wherein the coil comprises litz wire.

5. Apparatus as claimed in claim 2 further comprising an insertion port in the electrically insulating housing, the insertion port being dimensioned to be able to permit insertion of bar-shaped target material in solid form into the chamber.

6. Apparatus as claimed in claim 2 further comprising an insertion port in the electrically insulating housing, the insertion port being dimensioned to be able to permit insertion of a wire comprising target material in solid form into the chamber.

7. Apparatus as claimed in claim 2 further comprising an inlet port in the electrically insulating housing for supplying a buffer gas to the chamber.

8. Apparatus as claimed in claim 2 further comprising a port in the electrically insulating housing for applying a partial vacuum to the chamber.

9. Apparatus for supplying target material to a system for generating EUV radiation by creating a plasma from molten target material at a plasma site, the apparatus comprising:

a target material repository comprising a ceramic housing comprising a chamber for receiving target material in solid form through an insertion port in the ceramic housing, a coil in electromagnetic communication with the chamber and arranged to heat target material in the chamber by electromagnetic induction and convert target material in solid form in the chamber to target material in liquid form; and an outlet port in the ceramic housing for permitting melted target material to flow from the chamber, the ceramic housing also including an inlet port to permit introduction of a buffer gas into the chamber; and a coupler for releasably coupling the target material repository to a target material dispenser.

10. Apparatus for supplying target material to a system for generating EUV radiation by creating a plasma from molten target material at a plasma site, the apparatus comprising:

a target material loader including a target material repository adapted to receive bars of target material in solid form, the target material repository comprising:

a chamber for receiving the bars of target material in solid form;

an induction heater in electromagnetic communication with the chamber and arranged to heat target material in the chamber by electromagnetic induction and convert target material in solid form in the chamber to target material in liquid form;

the target material loader being adapted to be handheld;

a target material dispenser arranged to dispense the target material in liquid form to the plasma site; and a coupler for releasably coupling the target material loader to the target material dispenser for loading the target material with target material in liquid form.

11. Apparatus for supplying target material to a system for generating EUV radiation by creating a plasma from molten target material at a plasma site, the apparatus comprising:

a target material loader including a target material repository adapted to receive a wire comprising target material in solid form, the target material repository comprising a chamber for receiving the wire, an induction heater in electromagnetic communication with an interior of the chamber and arranged to heat the wire in the chamber by electromagnetic induction and convert target material in the wire in the chamber to target material in liquid form; and a coupler for releasably coupling the target material repository to a target material dispenser.

12. Apparatus as claimed in claim 11 wherein the chamber comprises a ceramic material.

13. Apparatus as claimed in claim 11 wherein the chamber comprises a glass material.

14. Apparatus as claimed in claim 11 further comprising:

a valve disposed between the chamber and the target material dispenser for controlling a flow of target material in liquid form between the chamber and the target material dispenser.

15. Apparatus as claimed in claim 14 wherein the valve is a ball valve.

16. Apparatus as claimed in claim 11 further comprising:

a spool for holding a quantity of the wire;

a wire transport system for feeding the wire from the spool to the chamber.

17. Apparatus as claimed in claim 11 further comprising a gas supply system for supplying gas to the interior of the chamber.

18. Apparatus as claimed in claim 17 wherein the gas is a forming gas.

19. A method of supplying target material to a system for generating EUV radiation by creating a plasma from a molten target material at a plasma site, the method comprising:

adding the target material in solid form to a target material repository;

inductively heating the target material in solid form in the target material repository to heat the target material in the target material repository chamber by electromagnetic induction and convert the target material in solid form in the target material repository to target material in liquid form;

releasably coupling the target material repository to a target material dispenser to supply the target material in liquid form to the target material dispenser; and disconnecting the target material depository from the target material dispenser when supplying the target material in liquid form to the target material dispenser is not required.

20. A method as claimed in claim 19 comprising an additional step carried out during the adding step of adding a gas to the target material repository while adding target material in solid form to the target material repository.

* * * * *